United States Patent [19]

Motill

[11] 4,368,825

[45] Jan. 18, 1983

[54] SELF-STANDING BOTTLE STRUCTURE

[75] Inventor: Richard M. Motill, Naperville, Ill.

[73] Assignee: Standard Oil Company (Indiana), Chicago, Ill.

[21] Appl. No.: 211,175

[22] Filed: Nov. 28, 1980

[51] Int. Cl.[3] ..... B65D 1/02

[52] U.S. Cl. ..... 215/1 C

[58] Field of Search ..... 215/1 C; 220/70

[56] References Cited

U.S. PATENT DOCUMENTS

| | | | |
|---|---|---|---|
| 3,598,270 | 8/1971 | Adomaitis et al. | 215/1 C |
| 3,727,783 | 4/1973 | Carmichael | 215/1 C |
| 3,759,410 | 9/1973 | Uhlig | 215/1 C |
| 3,871,541 | 3/1975 | Adomaitis | 215/1 C |
| 3,935,955 | 2/1976 | Das | 215/1 C |

*Primary Examiner*—Donald F. Norton

*Attorney, Agent, or Firm*—William C. Clarke; William T. McClain; William H. Magidson

[57] ABSTRACT

A self-standing bottle structure particularly suited for pressurized beverage bottles. The bottom end comprises a modified hemispherical portion, a convex central base portion, and an intermediate portion interconnecting the modified hemispherical portion and the convex central base portion. A plurality of convex elongated ribs in the intermediate portion which project inwardly to the base center portion and outwardly to the hemispherical portion form a plurality of legs in the intermediate portion, the legs being of smoothly arcuate concave shape and terminating in rounded portions of the hemispherical portion to form feet which lie in a plane normal to the central axis of the bottle structure and adapted to arrest tensile and bending stresses when subjected to internal fluid pressure and heat to provide a novel creep resistant structure.

3 Claims, 9 Drawing Figures

SELF-STANDING BOTTLE STRUCTURE

BACKGROUND OF THE INVENTION

This invention relates to the manufacture of bottles or containers of thermoplastic materials for the retention of fluids under pressure, such as carbonated beverages or the like. Recently, various thermoplastic materials have been developed which are capable of retaining carbon dioxide and which are blow-moldable into suitable containers. Such barrier materials include poly(ethyleneterephthalate) (PET), polyvinylchloride (PVC), or nitrile based resins known as LOPAC, a registered trademark of Monsanto Company, or nitrile-group-containing monomers of the type disclosed in U.S. Pat. No. 3,873,600.

One primary problem which is encountered in blow-molding thermoplastic materials to form bottles capable of retaining $CO_2$ and other gases under pressure resides in the provision of a bottom shape capable of serving as a bottle support, while resisting deformation under pressure. Mere duplication in plastic of traditional glass bottom configurations is unsatisfactory because of the tendency of plastics to creep or become distorted under pressure, especially in the presence of the elevated temperatures which may be encountered during shipment and storage. Such distortion may alter the shape and dimensions of traditional bottom configurations to the extent that the level of liquid within the bottle falls below the fill line, thereby threatening customer acceptance or satisfaction, and the bottle may become a so-called rocker; that is, it may become unstable on a horizontal surface.

On the other hand, it is frequently desirable that the inner and outer shapes and dimensions of plastic bottles approximate those of glass bottles of the same capacity so that they may be handled by existing equipment and, in certain instances, assist customer identification of the particular product they contain. In any event, they should be aesthetically attractive.

A plastic bottle, when filled with a carbonated beverage and capped, must be able to withstand both the impact of falling from at least a moderate height onto a hard surface and the precipitous rise in internal pressure which accompanies the impact. While this requirement also affects selection of materials and bottle-forming techniques, it is an extremely important consideration in the contemplation of bottom design.

Finally, the optimum bottom structure is one which not only meets the foregoing criteria but which may be readily formed with an economy of material, without unduly expensive or elaborate equipment, and without intricate or additional manufacturing steps.

It has been known for a long time that the strongest pressure vessel is one of a spherical shape. Its excellent performance is based upon a uniform distribution of stresses, tensile stresses in case of internal pressure and compressive stresses in case of external pressure. However, spherical containers or those with hemispherical bottoms require extra stands or footing (base cups).

Next to the hemispherical there is the domed bottom which has a built-in upsidedown hemisphere, a cone or construction between the two. However, under pressure domed bottoms bulge also. Despite its rigidity, the dome loses some of its depth and the base diameter decreases. After these changes, the bottle becomes taller and not as stable.

One of the most common bottom structures employed in glass bottles of the type intended to contain beverages under pressure is the so-called "champagne bottom," the outer surface of which comprises a central concavity and a convex heel surrounding the concavity and merging therewith and with an end portion of the container sidewall. The lowermost points of the heel lie in a common plane to support the bottle in an upright position on a horizontal surface. Such a bottom configuration in the appropriate thickness may be wholly satisfactory in glass because of the rigidity of that material.

When the champagne bottom is translated to a thin-walled plastic container, however, the central concavity has a tendency to evert to convexity under internal pressure, thereby rendering the bottle unstable on a horizontal surface. Even if outright eversion does not occur, internal pressure tends to cause the bottom structure to "roll out" or flex outwardly at the juncture of the concavity and the surrounding heel, whereby the concavity becomes shallower and the radial dimension of the heel is altered. This, in turn, causes an increase in the volume enclosed by the bottle and a corresponding lowering of the level of liquid contained. Bottle engineering and design of the champagne bottom is required to control these tendencies.

Various expedients intended to alleviate these conditions have been proposed heretofore. Among them are the bottom structures disclosed in U.S. Pat. No. 3,468,443. The wall of each of these bottom structures is shown to be of a uniform thickness no greater than that of the sidewall. The portion of the wall which defines the central concavity is described as a "web." To rigidify this web a plurality of external ribs interrupt the outer surface of the concavity and extend outwardly therefrom. The ribs are distributed in a symmetrical array, each rib extending longitudinally in the direction of the heel from an inner portion of the concavity. Even with the rigidity provided by the ribs, some degree of eversion or flexure is expected, because a further, central depression is necessary to ensure that the center of the web will remain spaced from a flat supporting surface.

U.S. Pat. No. 3,598,270 teaches a plastic container suitable for carbonated beverages. The bottom of the container comprises portions conformed to meridian elements of a hemisphere with a downward pole and a plurality of hollow legs terminating in feet in a plane below the pole of the hemisphere. Each leg is defined by sidewalls diverging upwardly and outwardly relative to the polar position.

U.S. Pat. No. 3,871,541 teaches a bottom structure for plastic containers wherein an integral reinforcing rim is provided to expose the bottom dome to compressive stresses only, to arrest tensile and bending stresses at the base of the dome and to cut excessive material from the dome wherein the least amount of plastic material is used.

As mentioned above, one suitable bottom shape is a simple, outwardly hemispherical shape, but when this shape is utilized for plastic containers, a hemispherical shape requires a separately applied, outer peripheral support to make the bottle stand upright. A less expensive but more practical shape for plastic containers results from the inversion of the outwardly hemispherical shape to the inwardly concave or "champagne bottom" shape. The transition region located at the juncture of the cylindrical bottle side wall with the inverted, concave bottom forms a seating ring upon which the bottle is supported in an upright position. Much effort has been devoted to the design of inverted, concave bottoms of this type, and many different methods and many different molds have been developed.

It has been proposed that an initial outwardly convex bottom be blown which is then inverted to form a final upwardly concave bottom. Methods and apparatus proposed either (1) require the utilization of a separate inversion mold and reheating of the initial bottom or (2) simply push a convex die against the outwardly convex bottom. Neither technique has solved the problems inherent in the requirements of sharp curvatures in the transition zone and of adequate material thickness at the seating ring.

As a result, the prior art has not yet evolved a suitable bottom shape for forming a concave, pressure-resistant bottom for a thermoplastic container of light weight capable of retaining fluids under pressure, having a bottom highly resistant to deformation.

SUMMARY OF THE INVENTION

A self-standing bottle structure particularly suited for pressurized beverage bottles wherein the bottom end comprises a modified hemispherical shape, a convex central base center and a plurality of convex elongated ribs which project inwardly to the base center and outwardly to the modified hemispherical shape to form a plurality of legs, the legs being of smoothly arcuate concave shape and terminating in rounded portions of the hemispherical shape to form feet.

DETAILS OF THE INVENTION

Figure 1:
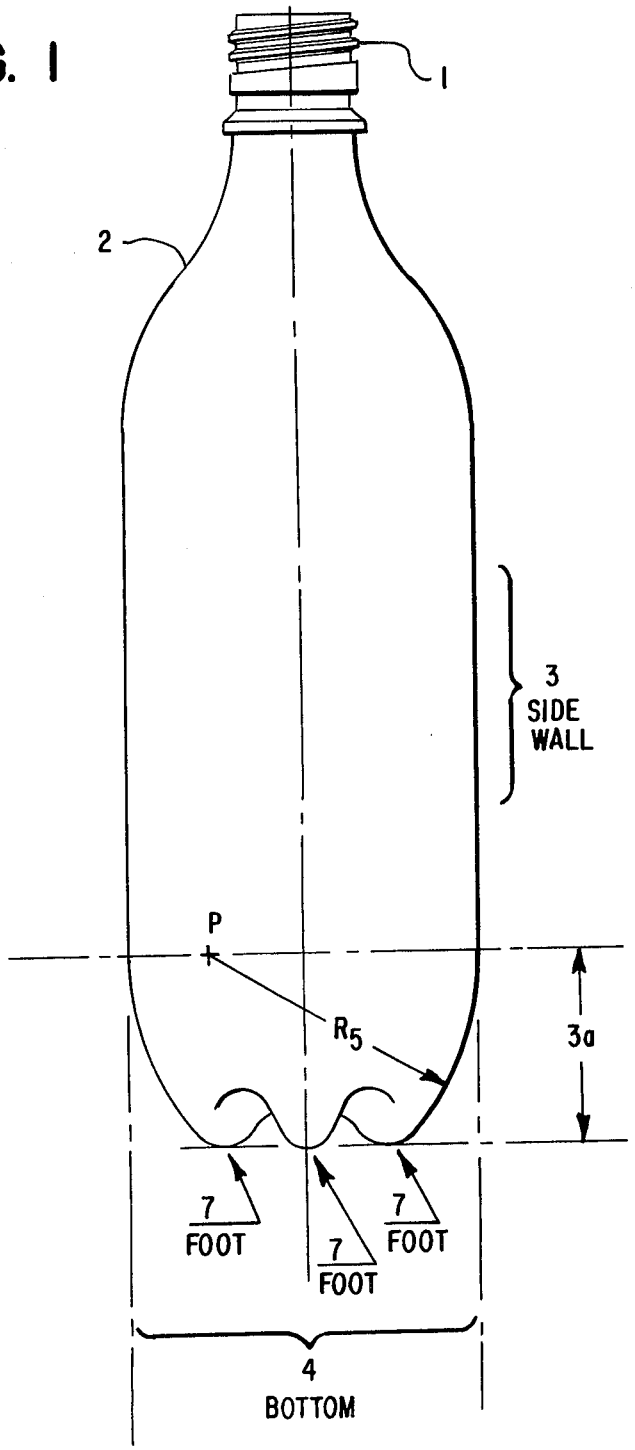
FIG. 1 is a side elevation of a bottle having a bottom end according to this invention.

This invention relates to a bottom structure particularly suited for self-standing pressurized beverage bottles wherein the bottom shape is formed with wall and feet portions comprising a hemispherical shape, an inwardly domed hemispherical shape to form a convex central bottom base center and a plurality of smaller inwardly domed convex elongated ribs which extend radially and merge with the wall and feet portions and domed bottom center. The inwardly curved elements rigidify the domed bottom center under conditions of internal pressure. The bottom shape can also be described as being formed with a riser which is concavely downward in the base center portion, and alternatively convexed downward and concaved downward in meeting the sidewall curve of the bottle. The riser can be described as an element of the base center curve and the rib curve in meeting the sidewall. In turn, the sidewall curve is alternatively extended downward to form a plurality of radially arranged configurations extending inwardly to said base center to form a juncture in a concave downward arc, said configurations serving as downwardly bulged legs and feet, the outer end of said legs serving as feet upon which the bottle rests, the sidewalls of said rib configuration serving as the legs.

Accordingly, it will be noted that the bottom shape of the bottle structure comprises a hemispheroidal shape. which is interrupted at regularly spaced intervals by inwardly domed projections into the bottom base to provide legs and feet for the structure and to impart strength to the base center by the formation of ribs between the upwardly domed projections. It is an essential element of the instant invention that the feet be of the hemispheroidal bottom portion of the bottle structure to preserve the hemispheroidal structure of the bottom shape and accordingly partake of the structural advantages of the hemispheroid shape. It is an essential element that the regularly spaced ribs extend from the base center portion to the sidewall and not be of the rim or sidewall portion of the hemispheroidal bottom in order to maintain the integrity of the hemisphere. It is an essential element that the ribs be provided by domed or concave projections into the hemispheroid bottom, the domed projections being of smoothly arcuate concave shape in the bottom shape which merge at their extremities with the base center and with the sidewall of the bottle structure to form a rib section. The merge of the arcuate concave projections which constitute the legs with the sidewall of the bottle is the critical area where compressive stresses are changing to flexural (bending) and tensile stresses. It is essential that the merge be a rounded curve or arc to arrest the critical tensile stresses in this area.

Accordingly, the object of the instant invention is to provide a bottom structure for a pressurized beverage bottle which has strength of a hemispherical bottom and feet to stand upright. Another object of this invention is to provide a bottom structure wherein the tensile stresses are arrested at the merge of the legs with the sidewall. Another object of this invention is to provide a stable bottle which is acceptable in its shape to the bottling industry and can be made by blow molding, injection blow molding, or re-heat blow molding.

FIGS. 1 through 9 show a bottom end structure according to this invention as incorporated in a bottle suitable for carbonated beverages. Although such bottles represent a principal application of this invention, it will be understood that the invention is applicable to containers generally.

Referring to FIGS. 1 through 9, a container in the form of a bottle is constructed generally in accordance with the invention and is formed of a thermoplastic synthetic resinous material having gas barrier properties to a degree such that the bottle will be suitable for containing an effervescent or carbonated beverage at least throughout expected shelf time; that is to say, the period from bottling to consumption. The bottle is blow-molded from an extruded or injection-molded preform or parison and has preferably been so worked that the material is biaxially oriented.

Referring to FIG. 1, the bottle is provided with an upper neck portion 1 having any desired neck finish, such as the threaded finish shown. A sidewall 2 and 3 of any suitable form extends from the neck portion to a bottom structure, indicated generally at 4, which closes the lower end of the sidewall. End portion 3*a* of the sidewall curve of the bottom structure is formed with an outer surface which is generally symmetrical about a central upright axis which is generally off-center of the axis of the bottle, such as shown, although other forms may be substituted within the purview of the invention including a sidewall curve wherein the outer surface is symmetrical about the central upright axis of the bottle.

The outer surface of end portion 3*a* of bottom structure 4 includes an arc of radius $R_5$. Surface 3*a* merges at its radially outer margin with sidewall 3 and at its radially inner margin with foot portion 7.

Figure 2:
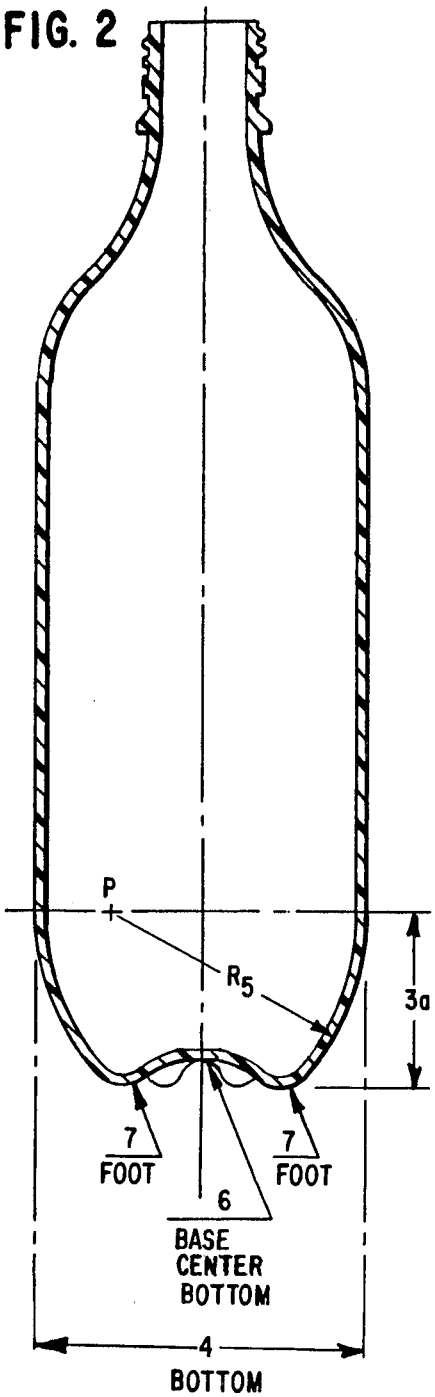
FIG. 2 is a vertical section through the bottle shown in FIG. 1 wherein the feet are shown.
Figure 3:
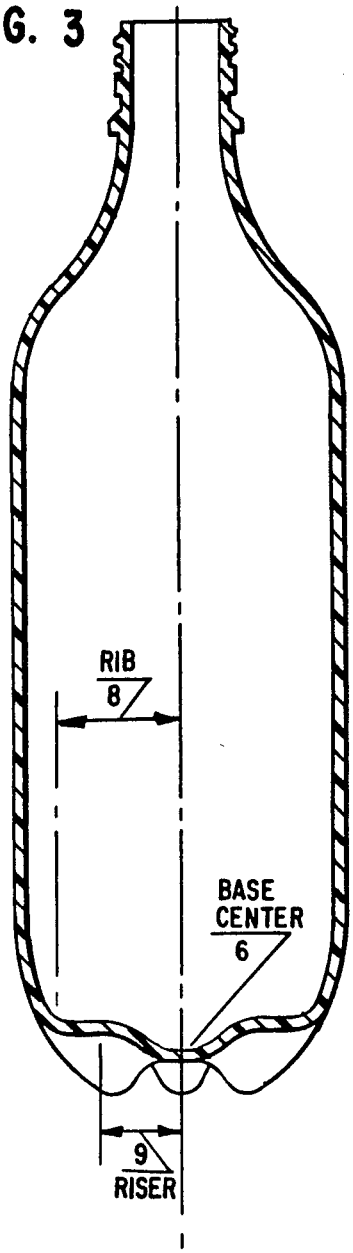
FIG. 3 is a vertical section through the bottle shown in FIG. 1 wherein risers and ribs are shown.
Figure 4:
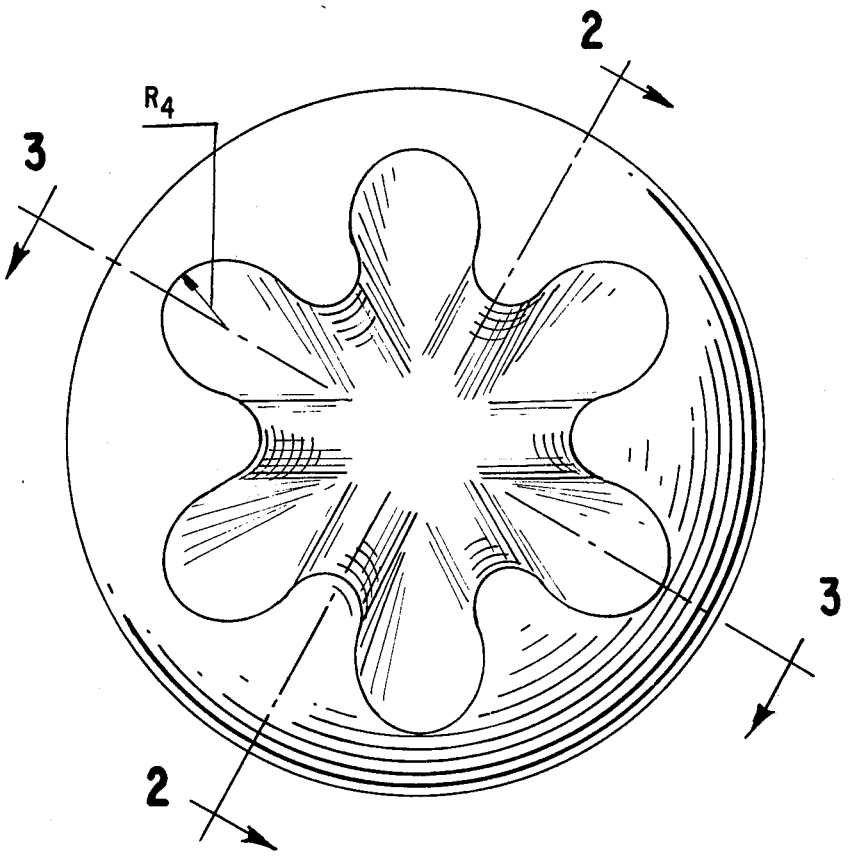
FIG. 4 is a bottom view of the bottle shown in FIG. 1. Plane 2—2 is vertical section of FIG. 2. Plane 3—3 is vertical section of FIG. 3.
Figure 5:
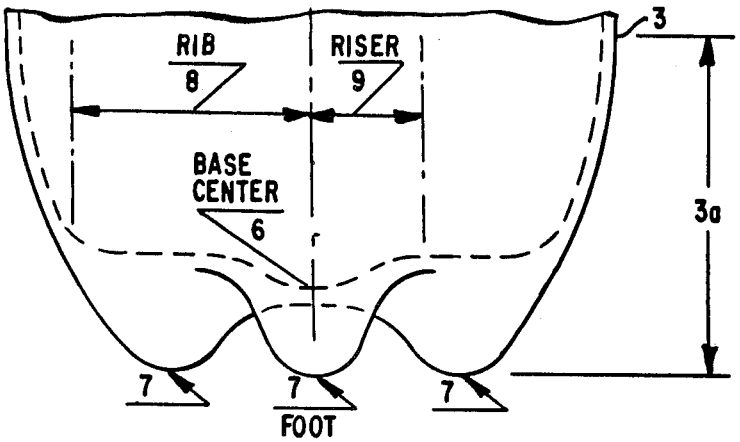
FIG. 5 is a partial side view of the bottom of the bottle in FIG. 1 which shows location of riser and rib.
Figure 6:
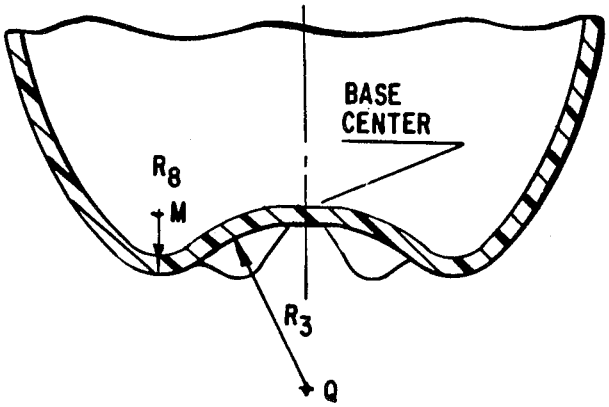
FIG. 6 is a partial vertical section through the leg and foot of the bottle in FIG. 1.
Figure 7:
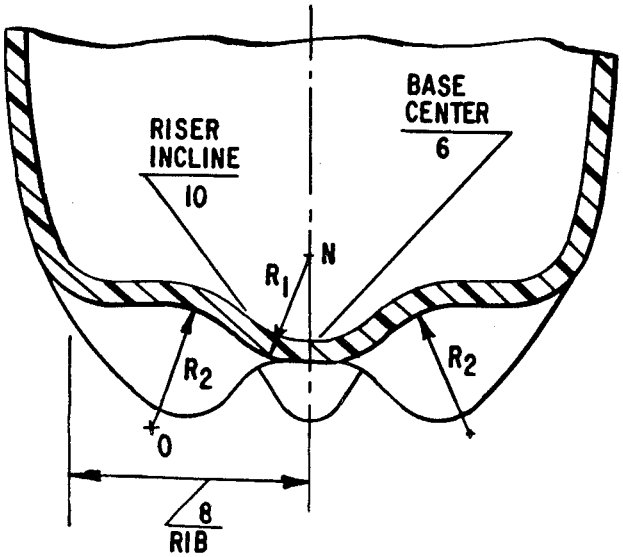
FIG. 7 is a partial vertical section on line determined by the riser of the bottle in FIG. 1.
Figure 8:
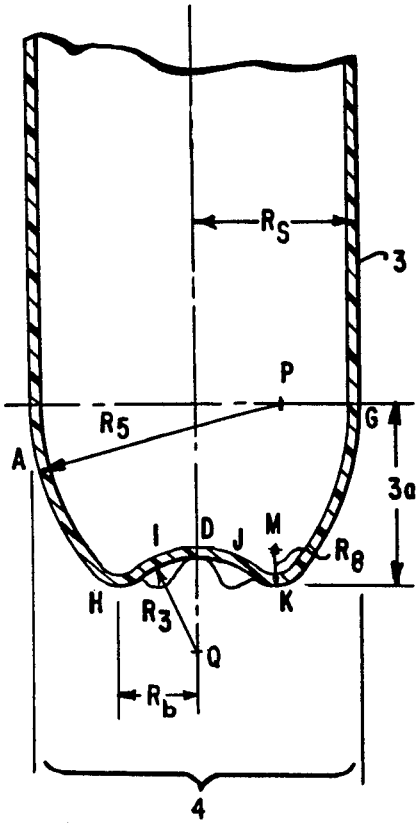
FIG. 8 is a cross section of feet and base center with radii.
Figure 9:
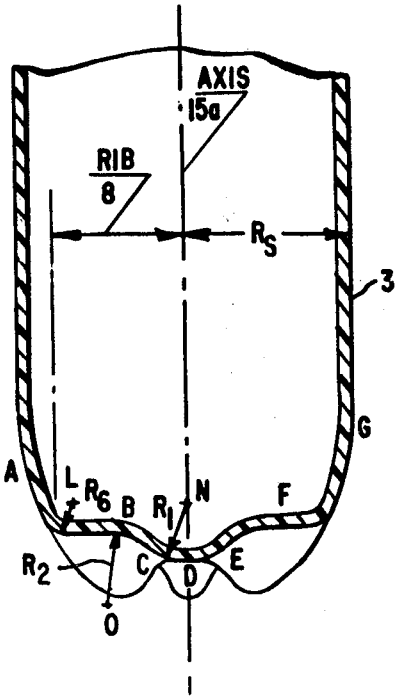
FIG. 9 is a cross section of ribs and base center with radii.

In FIGS. 2 and 3 details are shown of bottom structure from FIG. 1, the base center 6, the foot 7, the rib 8, and the riser 9 which is a part of the rib, the number of ribs being the same as the number of feet. FIG. 4 is a bottom view. Plane 2—2 is the vertical section of FIG. 2. Plane 3—3 is the vertical section of FIG. 3. Intersection of the inwardly domed elements with the hemispherical bottom shape are curves of radius $R_4$, the radius $R_4$ being determined by the number of feet. FIG. 5 is a side view of the bottom and feet which illustrates the position of the riser 9 and rib 8 relative to the position of each foot 7 and base center 6. Vertical section of Plane 2—2 of FIG. 6 illustrates formation of each foot 7 by an arc of radius $R_8$ which is tangent to an arc of adius $R_3$ forming the convex central base center 6 which forms a flat mid-point at the juncture of $R_1$ and $R_3$ because of gate requirements in the molding operation. Vertical section of Plane 3—3 of FIG. 7 illustrates incline 10 of the riser from base center 6 as part of rib 8 which is an arc of radius $R_1$ whose center point lies on the axis of the bottle. Incline 10 merges with an arc of radius $R_2$ to produce rib section 8. FIGS. 8 and 9 are cross-sectional views indicating radii.

FIGS. 8 and 9 represent a specific embodiment of the invention in the form of two radial profiles of the outer surface of the bottom structure taken at separate angular locations. The profile of end portion 3*a* of the outer surface of the adjacent sidewall end portions at separate angular projections is shown.

In more detail, as shown in FIGS. 2 and 3, a plurality of ribs 8 interrupt the outer surface of the modified hemisphere generated by arc of radius $R_5$. The ribs are distributed in a symmetrical array, each rib extending longitudinally in the direction toward base center 6 and downwardly from intersection with the sidewall 3 to the base center 6. Origin of radius $R_5$ is P which is a distance 3*a* above foot 7. As illustrated in FIG. 3, ribs 8 are convex upwardly and radially arrayed. While six such feet are shown (FIG. 4), the number may vary in accordance with the degree of rigidity to be provided and by the overall dimensions determined by bottle size and wall thickness of the bottom structure and individual ribs.

As shown in FIG. 5, the outer end of each foot 7 merges with sidewall 3, the inner end merges with the base center 6, the outer end of each foot being lower than the inner end thereof. The lowermost surfaces of feet 7 lie in a plane normal to the central axis of the bottle, whereby the bottle may be supported on a horizontal surface in an upright position.

FIGS. 6 and 7 show the details of the base center 6 formed by the meeting of $R_1$ and $R_3$. The profile in FIG. 8 AHIDJKG includes two of the legs, the profile extending radially from the axis to the sidewall profile through the lowermost points of the legs, H and K. In the embodiment of FIG. 8, arc AH has a radius $R_5$ which originates in Point P. Arc IDJ has a radius $R_3$ which originates in Point Q. Arc JK has a radius $R_8$ which originates at Point M.

It will be noted that feet 7 are hollow and the wall of bottom structure 4 generally decreases in thickness from the innermost point of base center 6 to end portion of sidewall 3. However, deviations from this progressive decrease in wall thickness are well within the purview of the invention.

It is to be noted that the valley-like outer surface of said legs comprise a smoothly arcuate concave inward shape or dome which, in effect, is generated by rounded concave projections between the base center and hemispheric configuration of the sidewall, the extent of the projection into the sidewall according to the curve of the riser. Accordingly, the valley-like surface of the individual legs comprise a concave surface which meets the rounded curve of the sidewall and extends to the base center. The shape of the bottom end is accordingly a composite of a series of tangential curves which merge with each other and avoid sharp angular transitions with consequent concentration of tensile stresses.

The outer radial dimension $R_s$ of the sidewall of the bottle will in some cases be radius $R_5$ and established to coincide with the equivalent dimension of existing bottles of the same capacity, whereby to facilitate customer identification and accommodate existing filling and handling equipment. The dimension $R_b$ in FIG. 8, which is the radial distance between axis 15*a* and the lowermost points H and K of the feet, is selected to provide an acceptable degree of upright stability when the bottle is supported on a horizontal surface but is smaller than dimension $R_s$ for the reason that the feet 7 are of the hemispheroidal configuration of the bottom shape.

As shown in FIG. 9, each rib 8, ABCD and DEFG, merges with adjacent portions of the wall of the bottom structure at A and G. Being angularly spaced, each pair of adjacent ribs are separated from one another by a foot 7 (shown in FIG. 2). It will be noted that the ribs comprise risers which are in effect internal ribs at BCD and DEF. In any event, the ribs are of configuration as shown in FIG. 9.

More particularly, the cross-sectional profile of ABCDEFG in FIG. 9 illustrates how each rib extends radially from the central upright axis 15*a* of the bottle, from the lowermost point D of the base center, to sidewall profile 3.

In the embodiment of FIG. 9, the maximum depth of the concavity C and E is shallow relative to dimension $R_s$ and therefore the central portion of the concavity profile has a nearly flat configuration. Segment BC is a concave arc tangent to segment AB at point B. Segment AB has a radius of curvature $R_6$ originating at a point L. Segment DE is an arc having a radius $R_1$, which is substantially greater than radius $R_6$ and which originates at a point N. Segments CD and DE form a nearly flat mid-point because of gate requirements in the molding operation. Arc BC has a radius $R_2$ which originates at a point O.

Accordingly, one embodiment of the invention as shown in FIGS. 8 and 9 comprises a self-standing bottle structure particularly suited for pressurized beverage bottles wherein the bottom end is formed with a hemispheroidal shape, a base center portion and ribs which individually comprise a series of arcs of sequential radii $R_5$, $R_6$, $R_2$, and $R_1$ respectively wherein $R_5$ forms a hemispherical curve with the sidewall of said bottle, and $R_6$ is in a tangential juncture with sidewall curve $R_5$ and $R_2$, $R_2$ projecting upward and downward to form with $R_1$ the rib configurations of the said bottle which extend from the sidewall of the said bottle to base center, and wherein outer surfaces of leg configurations comprise valley-like smoothly arcuate concave shapes extending from the hemispherical segment of the sidewall to the base center and serve to form foot configurations. Accordingly, this invention comprises a self-standing bottle structure formed of a thermoplastic material selected from the group consisting of poly(ethyleneterephthalate), polyvinylchloride and nitrile-based barrier resins particularly suited for pressurized beverage bottles wherein the bottom end is formed with a base center portion which is the midpoint of an arc of radius $R_1$ and an upwardly convexed riser which upwardly meets by means of arc of radius $R_2$, the inward concave arc of radius $R_6$, arc of radius $R_6$ meeting with arc of radius $R_5$, arc of radius $R_5$ forming a modified hemisphere interrupted by a plurality of radially arranged rib configurations which comprise said series of tangential arcs of radii $R_6$, $R_2$ and $R_1$ wherein $R_6$ and $R_1$ are downwardly convex-shaped, and $R_2$ is upwardly concave, said rib configurations extending from the sidewall of the bottle inwardly to the juncture of the aforesaid portions as the base center and forming a plurality of downwardly bulged legs arranged in a radial pattern and adapted to arrest tensile and bending stresses when subjected to internal fluid pressure and heat to provide a novel creep resistant structure.

It is to be noted that the term "arc" is used throughout this specification in its special sense as meaning a continuous portion of a cicle; that is, a curved line having a constant radius of curvature. The word "curve," on the other hand, is used as a generic term, and a curve may therefore comprise a composite line which includes a plurality of arcs, or arcs and straight lines arranged in a continuous tangential series.

In summary, the instant invention comprises a thermoplastic container for pressurized fluid materials adapted to arrest tensile and bending stresses when subjected to internal fluid pressure and heat comprising a generally cylindrical sidewall portion having an opening at its upper end, a bottom portion at the other end of said sidewall portion having a modified hemispherical shape, the bottom portion comprising a lower sidewall portion in the form of a hemispherical segment of constant radius, a convex central base portion, an intermediate portion interconnecting the convex base portion and the modified hemispherical shape, a plurality of convex elongated radial ribs forming a plurality of legs in the intermediate portion, the ribs projecting inwardly to the convex central base portion and projecting outwardly to the hemispherical segment, meeting the hemispherical segment in a smoothly merging juncture, the outer wall of the legs being of smoothly arcuate concave shape, the legs terminating in a rounded portion of the hemispherical segment forming feet which lie in a plane normal to the central axis of the container. The range of radius of curvature $R_5$ of the modified hemispherical shape is within the range between diameter of the container to one-half of the diameter of the container with the limit being that $R_5$ is tangent to $R_8$ to sidewall 3. The range of radii of the convex central base portion arc $R_3$ is from $\frac{1}{4}$ to 4 inches. The radial ribs comprise a curve of three radii $R_1$, $R_2$, and $R_6$ wherein the radius of curvature of concave central base portion arc $R_1$ is from $\frac{1}{4}$ to 4 inches of arc, $R_2$ is from 5/16 to $1\frac{3}{4}$ inches, and of arc $R_6$ is between 0.1 to 0.6 inches. The arcuate concave shape of the legs of radius $R_4$ is from $\frac{1}{4}$ to $6\frac{1}{2}$ inches. Radius of the rounded portions of the hemispherical sections forming feet $R_8$ is from one-half to one inch.

While the invention has been particularly described with certain specific embodiments thereof, it is to be understood that this is by way of illustration and not intended to limit the scope of the invention.

What is claimed is:

1. A container of thermoplastic material for pressurized fluid materials adapted to arrest tensile and bending stresses when subjected to internal fluid pressure and heat comprising:

(a) a generally cylindrical sidewall portion having an opening at its upper end, (b) a bottom portion of the other end of said sidewall portion, (c) said bottom portion comprising a lower sidewall portion in the form of a modified hemispherical shape of constant radius, (d) a central base portion, having an upwardly projecting concave surface, (e) an intermediate portion interconnecting said base portion and said modified hemispherical shape, (f) a plurality of upwardly projecting elongated radial ribs between a plurality of legs in said intermediate portion, said ribs projecting inwardly to said central base portion and projecting outwardly to said hemispherical shape, meeting said hemispherical shape in a smoothly merging junction, said radial ribs consisting essentially of a curve of three radii, (g) the outer surface wall of said legs being of smoothly arcuate projecting downward convex shape and extending from said hemispherical shape to said base center, said legs terminating in a rounded portion of said hemispherical shape forming feet which lie in a plane normal to the central axis of the said container.

2. In a container as defined in claim 1 wherein the radius of curvature of (a) said modified hemispherical shape is within the range of from the diameter of said container to one-half the diameter of said container wall, (b) said concave surface of central base portion is within the range of from $\frac{1}{4}$ to 4 inches, (c) said radial ribs comprise said curve of three radii wherein radius of curvature of said upwardly projecting concave surface of central base portion is within the range of between $\frac{1}{4}$ to 4 inches, said radius of curvature of said concave surface of said base portion is tangent to a second radius of a second surface having an arc of radius of curvature within the range of between 5/16 to $1\frac{3}{4}$ inches, said arc of said second surface is tangent to a third arc of radius of curvature of a third surface within the range of between 0.1 to 0.6 inches to form smoothly merging juncture of said ribs with said modified hemispherical shape, (d) the radius of said legs having an arcuate convex shape the radius of which is between $\frac{1}{4}$ to $6\frac{1}{2}$ inches, (e) the radius of said rounded portion of said hemispherical shape forming feet is from $\frac{1}{2}$ to 1 inch.

3. In a container as defined in claim 1 wherein said thermoplastic material is selected from the group consisting of poly(ethyleneterephthalate), polyvinylchloride and nitrile-barrier resins.

* * * * *